US005277018A

United States Patent [19]

Pujol-Isern

[11] Patent Number: 5,277,018

[45] Date of Patent: Jan. 11, 1994

[54] METHOD FOR CONNECTING TWO YARN ENDS TO ONE ANOTHER AND A CONNECTION OBTAINED BY THIS METHOD

[76] Inventor: Carlos Pujol-Isern, Calle Vergos 54, Barcelona, Spain, 08017

[21] Appl. No.: 808,915

[22] Filed: Dec. 18, 1991

[30] Foreign Application Priority Data

Dec. 19, 1990 [EP] European Pat. Off. ..... 90500124.4

[51] Int. Cl.[5] ..... D01H 15/00

[52] U.S. Cl. ..... 57/22; 57/10 N; 57/2.3

[58] Field of Search ..... 57/10 N; 2, 3, 22, 23, 25, 26, 27

[56] References Cited

U.S. PATENT DOCUMENTS

| | | | |
|---|---|---|---|
| 2,515,172 | 7/1950 | Abbott | 57/22 |
| 4,240,247 | 12/1980 | Matsui et al. | 57/22 X |
| 4,292,796 | 10/1981 | Mima | 57/22 |
| 4,494,367 | 1/1985 | Badiali | 57/22 |
| 4,813,220 | 3/1989 | Isern | 57/22 |

FOREIGN PATENT DOCUMENTS

| | | |
|---|---|---|
| 39609 | 11/1981 | European Pat. Off. . |
| 100389 | 2/1984 | European Pat. Off. . |
| 249578 | 12/1987 | European Pat. Off. . |

*Primary Examiner*—Daniel P. Stodola
*Assistant Examiner*—William Stryjewski
*Attorney, Agent, or Firm*—Nixon & Vanderhye

[57] ABSTRACT

In a method for connecting two yarn ends to one another, each yarn end is held at two longitudinally spaced apart points and an axial untwisting is introduced. These two untwisted ends are then joined together head to tail by gripping the central portion. There is next induced in the untwisted portion of each end between the central gripped portion and the respective yarn holding point by means of which the untwisting was induced, an axial excess untwisting with simultaneous winding of the free fibre ends about the portion subjected to excess untwist. The twist is retransferred by releasing the central portion during this operation.

3 Claims, 1 Drawing Sheet

METHOD FOR CONNECTING TWO YARN ENDS TO ONE ANOTHER AND A CONNECTION OBTAINED BY THIS METHOD

BACKGROUND OF THE INVENTION

1. Field of the Invention

The present invention relates, on the one hand, to a method for splicing two yarn ends to one another according to which each of these ends is held at two longitudinally spaced-apart locations and an axial untwisting of the yarn is introduced by transfer of the twist of these ends to the adjacent portion of the yarn by rotating one of the holding points for each of these ends, they are joined together head to tail by gripping the central portion of these ends thus joined together and by exerting an axial tensile force, the holding location for each end which has not served to induce the untwisting is removed to form an untwisted portion by freeing the fibres at this end which are not held, and the twist is retransferred towards these ends to re-establish there the twist of the yarn, and, on the other hand, to a splice obtained by this method.

2. Description of the Prior Art

Such a method is described in EP-A1-0 249 578. The problem which is encountered with this method of splicing according to which restoration of the twist in the ends of the spliced yarns is sought, is that the ends of the untwisted portions, which tend not to participate in the twisting induced in these ends, reduce the strength of the splice.

A method of splicing has already been proposed in EP-B1-0 100 389 according to which an excess untwisting is induced in the two sections of the yarns to be spliced, these two segments thus over-untwisted are then assembled side by side and head to tail, and the twist is then reintroduced. The negative twist induced in the yarn sections to be connected has the effect of producing a mutual compression of the sections at the time of retwisting, rendering the fibres of the individual yarns practically parallel, procuring in consequence the maximum contact surface between the two yarns.

BRIEF SUMMARY OF THE INVENTION

The aim of the present invention is to resolve the above-mentioned problem by forming different twisting zones along the length of the section connecting the two yarns with a view to strengthening the two ends of this section in which the ends of the two untwisted fibre portions tend not to take part in the twisting and to reduce the strength of the connection.

Accordingly, the present invention provides a method for splicing two yarn ends to one another comprising the steps of:

(a) holding each yarn end at two longitudinally spaced apart locations, (b) for each yarn end, rotating one of said locations to introduce an axial untwisting of the yarn by transferring the twist of the yarn end to a portion of the yarn adjacent the yarn end, (c) for each yarn end, exerting an axial tensile force to separate fibres of the yarn end held by said rotating holding location from fibres of the yarn end held by the other of the holding locations, at least a majority of the fibres held by the rotating location defining an untwisted portion of the yarn end having free fibre ends, (d) removing said other of the holding locations, (e) gripping together the central portions of the two yarn ends, (f) introducing into the untwisted portion of each yarn end located between the central gripped portion and the rotating holding location for said each yarn end an axial excess untwist while simultaneously effecting winding of the free fibre ends of the other yarn end about the portion of said each yarn end subjected to said axial excess untwist, (g) retransferring the axial untwisting of each yarn end towards the free fibre ends of said yarn end to re-establish the twist of the yarn, and (h) releasing the gripping together of the central portions of the two yarn ends during the retransfer of the axial untwisting. The invention also provides a splicing obtained by this method.

By virtue of the locally induced excess untwist at the base of each untwisted portion, after head to tail assembly of these, the free end of each untwisted portion is finally subjected to an excess twist due to its beginning to be wound around the portion subjected to excess untwist at the moment when the twisting begins to be reinduced. Given that the free end of each untwisted portion has not been subjected to excess untwist, at the time when the portion subjected to excess untwist is retwisted and passes through a null twist, the untwisted portion is already wound about this portion of the base of the untwisted portion, so that once the connection is completed, these ends of the untwisted portions will have a greater twist than the rest of the section connecting the yarns.

BRIEF DESCRIPTION OF THE DRAWINGS

The accompanying drawings illustrate, diagrammatically and by way of example, an embodiment of the method the subject of the present invention.

DETAILED DESCRIPTION OF THE INVENTION

The apparatus used for carrying out the method which is the subject of the invention will not be described here, given that there is in question an apparatus of the same conception as that which is illustrated and described in EP-A1-0 249 578 to which reference may be made.

Figure 1:
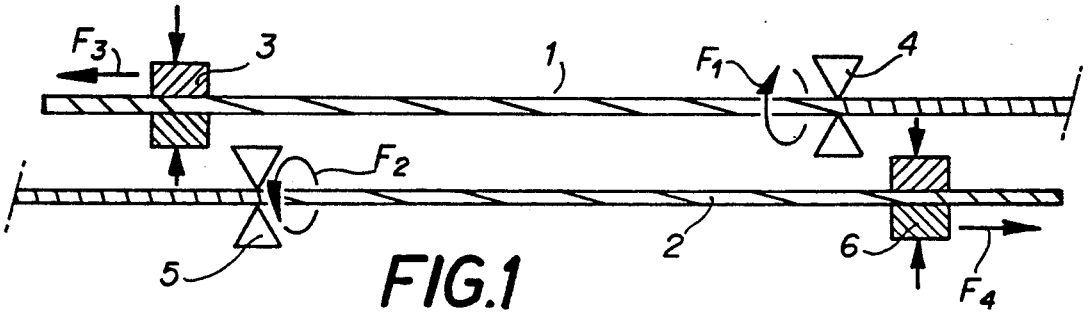
FIGS. 1 to 5 illustrate the different phases of the method.

FIG. 1 shows two textile yarns of spun fibres 1 and 2 which are to be spliced. With a view to facilitating understanding of the method, the yarn 1 has been drawn in black while the yarn 2 has been drawn in white. Each of the yarns is first of all gripped between two clamps 3, 4 and 5, 6 respectively The clamps 4, 5 are rotatably mounted about an axis which is the same as the axis of the yarn which they clamp. The distance separating two clamps gripping the same yarn is at least equal to the average length of the fibres forming the yarn. The clamps 4 and 5 are rotated in the opposite direction to the twist of the respective yarns. The clamp 4 rotates in the direction F1 while the clamp 5 rotates in the opposite direction F2. The number of rotated in the chosen to be equal to the twist of the yarns 1 and 2, so that the fibres of the sections of the yarns located between the clamps 3, 4 and 5, 6 respectively are substantially parallel, at least for a majority of the fibres.

Figure 2:
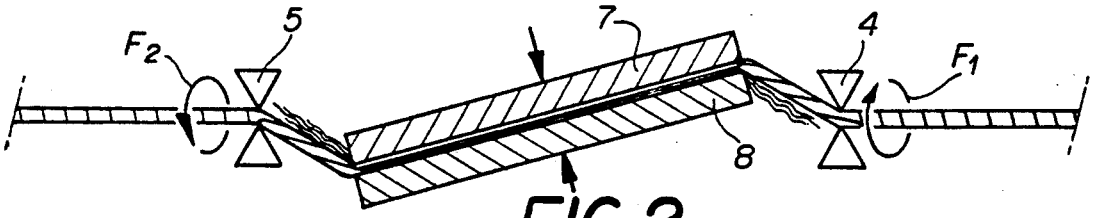

At this moment, a pulling force (arrows F3, F4) is exerted on these parallel fibre yarn sections to separate the fibres which are held by the clamps 4 and 5 from those which are held by the clamps 3 and 6. The fibres which are held by the clamps 3 and 6 are removed and the others are brought together between two plates 7 and 8 which are disposed at an angle with respect to the straight line which connects the clamps 4 and 5, so that the fibres of the two untwisted portions held by these clamps slide the ones against the others in the portion situated between the plates 7 and 8. The free ends of the untwisted portions are free while the bases of these untwisted portions are held between the plates 7 and 8 and the clamps 4, 5 respectively, as illustrated by FIG. 2.

While the two sections of yarn to be spliced are in this position, the clamps 4 and 5 are again rotated in the directions of the arrows F1, F2 respectively, inducing as a consequence an excess untwisting in the portion of the base of the untwisted fibre portions situated between the respective clamps 4 and 5 and the plates 7 and 8 which grip the central regions of the untwisted portions against one another. This excess untwisting has in particular the effect of strongly stretching the base portion of the untwisted fibre sections.

Figure 3:
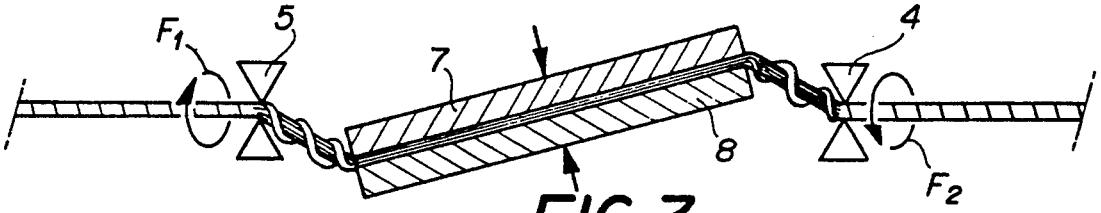
Figure 4:
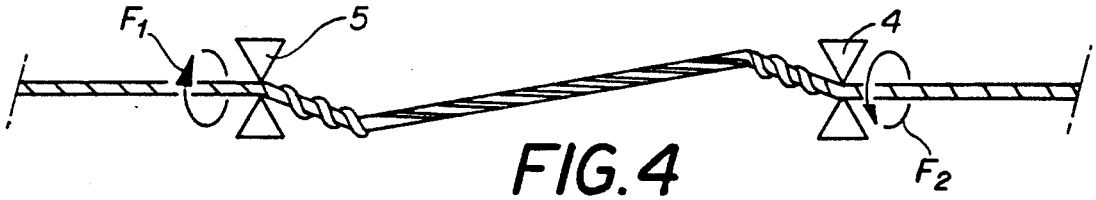

At a first due time (FIG. 3), rotation of the clamps 4 and 5 in the opposite direction begins, that is to say in the directions F2 and F1 respectively, which has the effect of progressively bringing to zero the twist in the portions subjected to excess untwisting. During this axial rotation in the direction of the twisting of these portions subjected to excess untwisting, the free ends of the untwisted fibre portions are driven in a helicoidal rotation about these portions subjected to excess untwisting, so that, when the twist of these portions subjected to excess untwisting is brought to zero, the free ends of these untwisted portions already have a positive twist.

The plates 7 and 8 are then released, but rotation of the clamps 4 and 5 in the direction of twist is continued, so that the twist is propagated into the central portion of the fibre section from its two ends until the twist is completely re-established.

Figure 5:
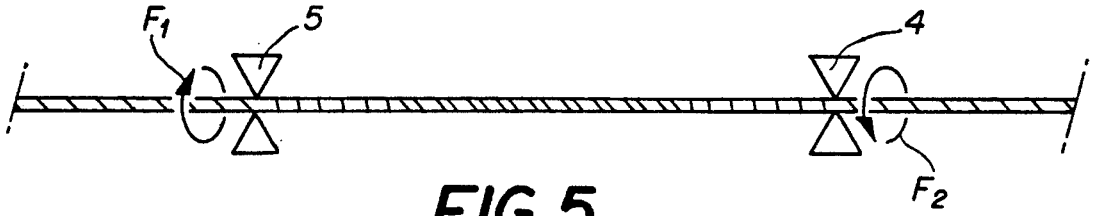

Given that the free ends of the untwisted fibre portions already had several turns of twist at the time when the remainder of these untwisted fibre portions had a null twist, the resulting yarn has a greater twist at the two ends of the connection than in the central portion, as illustrated by FIG. 5. This excess twist guarantees that all of the fibres participate in the twist as far as the ends of the untwisted portions and confer on the connection an increased strength which is generally more than 80% of the initial strength of the yarn, as well as an appearance which is very similar to that of the yarn.

I claim:

1. A method for splicing two yarn ends to one another comprising the steps of:

(a) holding each yarn end at two longitudinally spaced apart locations, (b) for each yarn end, rotating one of said locations to introduce an axial untwisting of the yarn until the fibres of each yarn end are substantially parallel, by transferring the twist of the yarn end to a portion of the yarn adjacent the yarn end, (c) for each yarn end, exerting an axial tensile force to separate fibres of the yarn end held by said rotating holding location from fibres of the yarn end held by the other of the holding locations, at least a majority of the fibres held by the rotating location defining an untwisted portion of the yarn end having free fibre ends, (d) removing said other of the holding locations, (e) gripping together central portions of the two yarn ends, (f) introducing into the untwisted portion of each yarn end located between the central gripped portion and the rotating holding location for said each yarn end an axial excess untwist, (g) retransferring said transferred axial twist towards said portion of each yarn end located between the central gripped portion and the rotating holding location for progressively bringing to zero the twist in the portions subjected to excess untwisting while simultaneously effecting winding of the free fibre ends of the other yarn end about the portion of said each yarn end located between the central gripped portion and the rotating holding location, (h) continuing retransferring said axial twist towards each yarn end while releasing the gripping together of the central portions of the two yarn ends.

2. A method according to claim 1 wherein steps (f), (g), and (h) result in a splice having a greater twist at opposite ends of the splice than in a central portion of the splice.

3. A splicing between two yarn ends obtained by the steps of:

(a) holding each yarn end at two longitudinally spaced apart locations, (b) for each yarn end, rotating one of said locations to introduce an axial untwisting of the yarn until the fibres of each yarn end are substantially parallel, by transferring the twist of the yarn end to a portion of the yarn adjacent the yarn end, (c) for each yarn end, exerting an axial tensile force to separate fibres of the yarn end held by said rotating holding location from fibres of the yarn end held by the other of the holding locations, at least a majority of the fibres held by the rotating location defining an untwisted portion of the yarn end having free fibre ends, (d) removing said other of the holding locations, (e) gripping together central portions of the two yarn ends, (f) introducing into the untwisted portion of each yarn end location between the central gripped portion and the rotating holding location for said each yarn end an axial excess untwist, (g) retransferring said transferred axial twist towards said portion of each yarn end located between the central gripped portion and the rotating holding location for progressively bringing to zero the twist in the portions subjected to excess untwisting while simultaneously effecting winding of the free fibre ends of the other yarn end about the portion of said each yarn end located between the central gripped portion and the rotating holding location, (h) continuing retransferring said axial twist towards each yarn end while releasing the gripping together of the central portions of the two yarn ends.

* * * * *